US005802800A

United States Patent [19]

Meyers

[11] Patent Number: 5,802,800

[45] Date of Patent: Sep. 8, 1998

[54] SIMULATED WOOD BEAM CONSTRUCTION

[75] Inventor: Leo J. Meyers, deceased, late of Pittsburgh, Pa., by Michael C. Meyers, executor

[73] Assignee: Sun Room Designs, Inc., Youngwood, Pa.

[21] Appl. No.: 651,526

[22] Filed: May 22, 1996

[51] Int. Cl.[6] ..... E04C 3/30

[52] U.S. Cl. ..... 52/731.21; 52/729.2; 52/737.6; 52/DIG. 8

[58] Field of Search ..... 52/731.2, 730.4, 52/732.1, 737.6, 729.2, DIG. 8, 729.4, 737.3

[56] References Cited

U.S. PATENT DOCUMENTS

| | | | |
|---|---|---|---|
| 1,586,053 | 5/1926 | Snyder | 52/737.6 |
| 2,082,792 | 6/1937 | Dean | 52/737.6 |
| 3,027,984 | 4/1962 | Dunn | 52/737.6 X |
| 3,332,179 | 7/1967 | Toti | 52/731.2 X |
| 3,332,197 | 7/1967 | Hinkle | 52/737.6 X |
| 3,336,708 | 8/1967 | Rambelle | 52/737.6 X |
| 4,034,957 | 7/1977 | Cody | 52/729.2 X |
| 4,156,999 | 6/1979 | Avery | 52/737.6 X |
| 4,350,318 | 9/1982 | Gallis | 52/737.6 X |
| 4,875,311 | 10/1989 | Meyers | 52/730.4 X |

FOREIGN PATENT DOCUMENTS

| | | | |
|---|---|---|---|
| 128131 | of 1919 | United Kingdom | 52/731.2 |

*Primary Examiner*—Carl D. Friedman
*Assistant Examiner*—Beth A. Aubrey
*Attorney, Agent, or Firm*—Lawrence R. Burns

[57] ABSTRACT

Simulated beam construction which has a central elongated I-beam member having opposing ends for connecting to opposing side panel members. The side panel members each have opposing lateral ends and later elongate panels extending between the lateral ends so as to enclose the central elongate I-beam. Flanged grooves on the lateral ends for sliding attachment to the lateral panels. The simulated wood beam construction has an I-beam member which is an elongate member, that when viewed in cross-section, has flanges or flanged slots on each opposite end for co-operative engagement with the opposing panel member. As an alternate embodiment it may be preferable to construct the I-beam of two substantial identical elongate members, fastened one to the other. A further and alternate embodiment of the present invention presents a simulated wood beam construction having elongate identical angle construction pieces adjacently placed in a paired relationship one to another with each paired relationship having an elongate angle side placed adjacent, but not abutting, an identical elongate angle side of the other. The pairs of the angle pieces are placed opposite one another in a side to side and top to bottom position to one another with a wire rod that connects each identical angle piece to its paired counterpart and each pair to its opposing counterpart.

5 Claims, 2 Drawing Sheets

SIMULATED WOOD BEAM CONSTRUCTION

BACKGROUND OF THE INVENTION

This invention deals with simulated wood beam configurations Used in the construction industry. Previously simulated wood beams have been manufactured with decorative wood strips fastened to the outside of aluminum or metal box-shaped tubular members. The metal structure of the beam itself makes the simulated wood beam design more durable and longer lasting than all wood counterparts. It is desirable that different decorative designs may be incorporated on the outward surfaces of the metal tube.

In the past the metal tubular members have been molded in a one or two piece fashion wherein each separate outward decorative design requires individualized and unique molding. In order to accomplish this, it was necessary to have in stock and keep an inventory of a large variety of the individual tubular members necessary for each outward design appearance. Keeping such an inventory is somewhat costly, and to that end, it is possible to reduce the inventory necessary for each outward design appearance that may be required.

OBJECTS OF THE INVENTION

It is an object of the present invention to provide a less expensive and more versatile construction for a simulated wood beam design.

It is an object of the present invention to construct a simulated wood beam member from standardized parts held in inventory.

It is an object of the present invention to provide a simple assembly for a simulated wood beam construction member.

It is an object of the present invention to provide a simulated wood beam construction member that has a central standardized I-beam adaptable for different decorative panel configurations.

It is an object of the present invention to provide simplified simulated wood beam construction members that can be easily assembled from standardized inventory.

It is an object of the present invention to provide a simulated wood beam construction member with a central I-beam for holding together versatile outward appearance panel members.

DETAILED DESCRIPTION OF THE DRAWINGS

Figure 1:
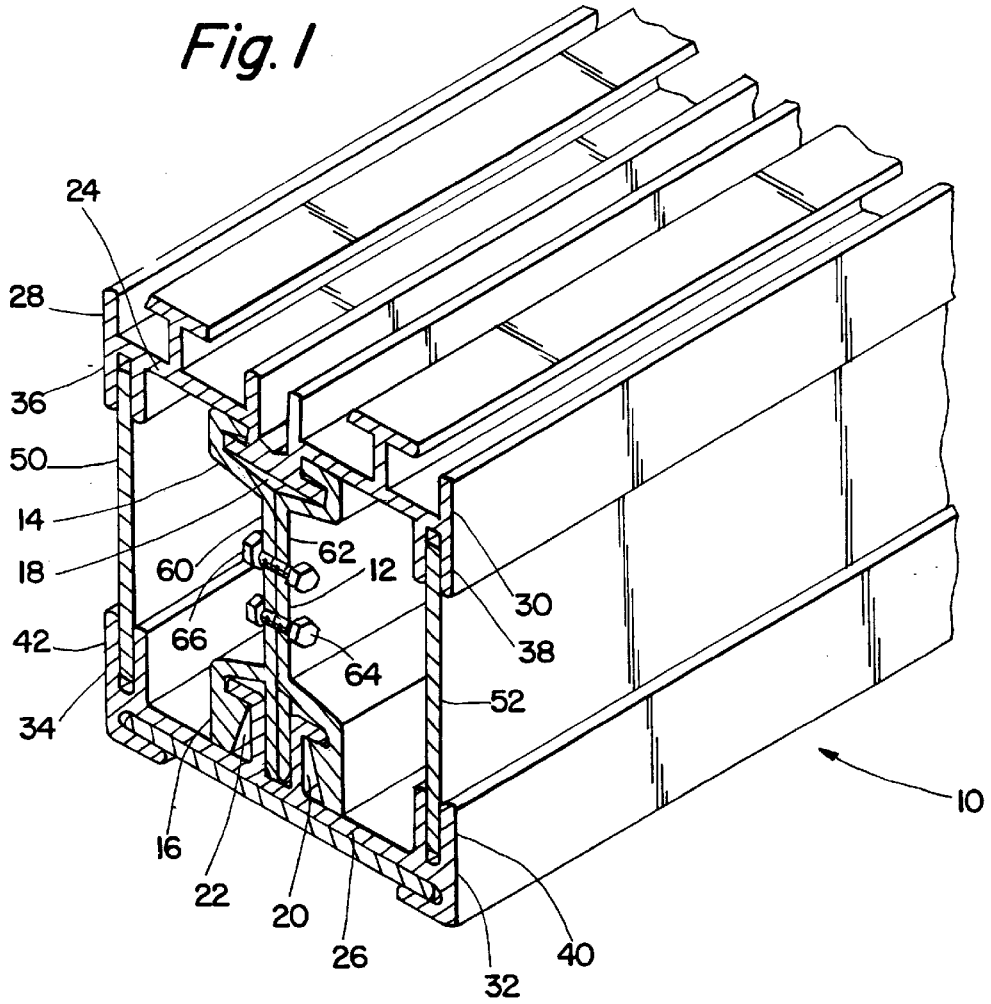
FIG. 1 is a perspective view of the simulated wood beam construction according to the present invention.

What is shown in FIG. 1 is a simulated wood beam construction member 10 having a central I-beam section 12. The central I-beam section 12 has opposing ends 14 and 16. Each of the opposing ends 14 and 16 having an enclosed flanged groove shown at 18. 20, and 22 for engaging opposing side panels 24 and 26. Each of the ends, respectfully 28, 30, 32 and 34 has a means for engaging a lateral panel shown at 36, 38, 40 and 42. In FIG. 1, such means are included with a cooperating groove such that the ends of the lateral panel shown at 50 and 52 are able to slide in and be held by the side panels. Means 50 and 52, when mated with the opposing side panels, completed enclosed the I-beam 12 that is shown in FIG. 1.

In addition to FIG. 1, the I-beam 12 is shown being comprised of two opposing members 60 and 62 that are substantially identical in cross-sectional similarity; that is that the member 60 and 62 would be identically made and stored in inventory that when pulled out, fasteners such as shown at 64 and 66 may be used to attach them together so that they may form the central I-beam of the similar wood construction 10 according to the present invention.

Figure 2:
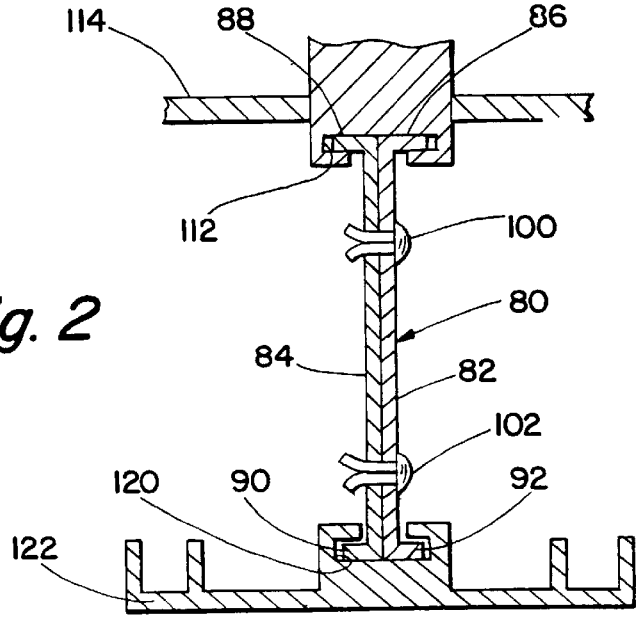
FIG. 2 is a cross-sectional view of an alternate I-beam construction according to the present invention.

What is shown in FIG. 2 is a cross-section view of an alternate I-beam 80 according to the present invention. The I-beam 80 has two sections 82 and 84 with each of the ends 82 and 84 having flanged sections shown at 86, 88, 90 and 92. The fasteners 100 and 102 hold the identical sections 82 and 84 in an abutting relationship so that the flanged sections 86 and 88 fit into a flanged groove shown at 112 on the side panel 114. On the opposing end and enclosed groove 120 is shown engaging the flanged ends 90 and 92 on the opposing panel 122.

Figure 3:
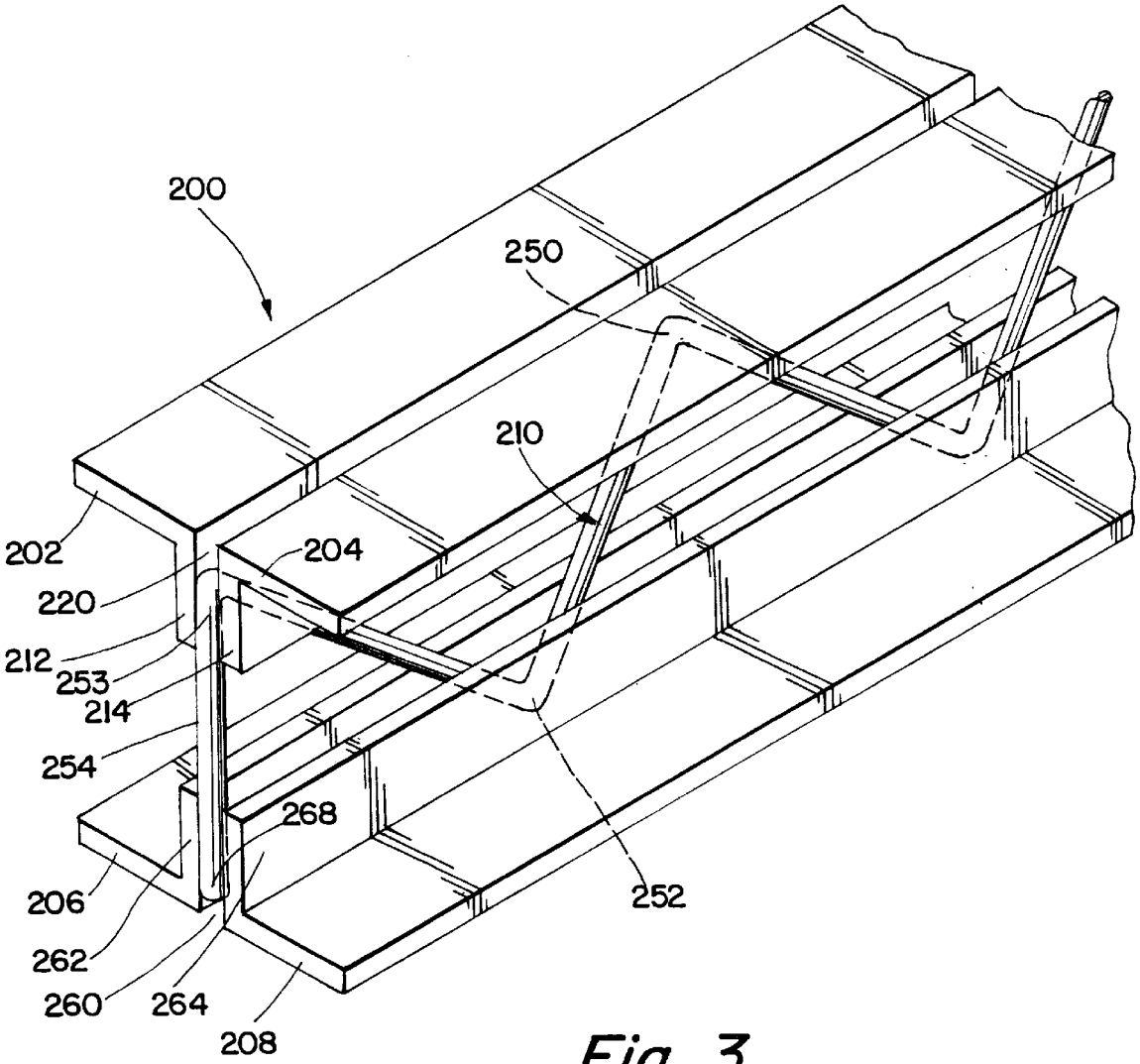
FIG. 3 is a perspective view of an alternate simulated wood beam construction according to the present invention.

What is shown in FIG. 3 is an adjustable I-beam construction 200 according to the present invention. The I-beam construction 200 consists of four elongate angle iron sections 202, 204, 206 and 208. The angle iron sections are identical and assembled with a wire 210 that extends between the angle iron sections 202, 204, 206 and 208. Sections 202 and 204 are mated such that angled sections 212 and 214 are adjacent to one another and will accept sections of the wire 210 which may be welded in the space 220 which is intermediate the angled sections 212 and 214 and the end irons 202 and 204. The wire 210 has sections shown at 250 and 252 and a straight section shown at 254. The section 250 has a bend that is welded so as to hold the angle plates 202 and 204 together. The section 253 is also welded is also welded so as to hold the angle plates 202 and 204, preferably by welding section 253 to the angle sections 212 and 214. A straight section 254 extends downward between the space 220 and into a space 260. Space 260 is a space formed between the angle sections 262 and 264 which are a part of the angle plates 206 and 208. The bottom-most section 268 of the straight section 254 will be welded to the sections 262 and 264 of the angle plates 206 and 268. In this way, when manufacturing the I-beam according to this construction, the outside decorative sections may be added by bending the wire and adjusting the height of the I-beam will be adjusted to the desired; for instance, the desired beam constructions will preferably be a 2 inch, 3 inch, or 4 inch beam, allowing for an adjustable height from the inventory approach that the manufacturer may have.

I claim:

1. A simulated beam construction which comprises:

a. a central elongate I-beam member having opposing ends;

b. side panel members mounted on said opposing ends with said side panel members having opposing lateral ends;

c. lateral elongate panels extending between said lateral ends of said side panel members so as to enclose said central elongate I-beam;

d. means on said lateral ends for sliding attachment to said lateral panels.

2. The simulated wood beam construction according to claim 1 in which said I-beam member comprises an elongate member that when viewed in cross-section has flanged slots on each opposite end for co-operative engagement with said side panel members.

3. The simulated wood beam construction according to claim 2 in which said I-beam member comprises an elongate member that when viewed in cross-section has flanges on each opposing end for co-operative engagement with said side panel members.

4. The simulated wood beam construction according to claim 2 in which said I-beam is comprised of two substantial identical elongate members fastened one to the other.

5. The simulated wood beam construction member according to claim 3 in which said I-beam comprises two substantially identical elongate members fastened one to the other.

* * * * *